US007000368B2

(12) United States Patent
Piemontese

(10) Patent No.: US 7,000,368 B2
(45) Date of Patent: Feb. 21, 2006

(54) METHOD FOR SEALING CAPSULES AND APPARATUS TO PERFORM SAID METHOD

(76) Inventor: Giuseppe Piemontese, Via del Palazzaccio 49, 50141 Florence (IT)

( * ) Notice: Subject to any disclaimer, the term of this patent is extended or adjusted under 35 U.S.C. 154(b) by 0 days.

(21) Appl. No.: 10/757,308

(22) Filed: Jan. 14, 2004

(65) Prior Publication Data

US 2004/0144066 A1 Jul. 29, 2004

(30) Foreign Application Priority Data

Jan. 14, 2003 (IT) ..... FI2003A0012

(51) Int. Cl.
*B65B 47/00* (2006.01)

(52) U.S. Cl. ..... 53/560; 53/234

(58) Field of Classification Search ..... 53/454, 53/560, 234, 233

See application file for complete search history.

(56) References Cited

U.S. PATENT DOCUMENTS

| | | | | |
|---|---|---|---|---|
| 3,978,640 | A * | 9/1976 | Crossley et al. | 53/468 |
| 4,584,817 | A * | 4/1986 | Yamamoto et al. | 53/329.2 |
| 4,922,682 | A * | 5/1990 | Tait et al. | 53/137.2 |
| 4,942,715 | A * | 7/1990 | Focke | 53/202 |
| 5,474,092 | A * | 12/1995 | Moser et al. | 131/280 |
| 6,434,911 | B1 * | 8/2002 | Yamamoto et al. | 53/53 |
| 6,516,589 | B1 * | 2/2003 | Draghetti et al. | 53/466 |

* cited by examiner

*Primary Examiner*—Eugene Kim
(74) *Attorney, Agent, or Firm*—McGlew & Tuttle, PC

(57) ABSTRACT

The capsules are disposed on a first rigid support (A1) movable in steps provided with a first plurality of seats (B1) designed to each contain a respective capsule (7), the support (A1) being designed to feed the capsules to means (5) designed to distribute a sealing solution along the rim of the cap (7B) of each capsule. The capsules (7) that have received the solution are then transferred from said first rigid support (A1) to a second rigid support (A3) movable in steps provided with a second plurality of seats (B3) designed to contain a respective capsule (7), the second rigid support (A3) then in turn transferring the capsules (7) to an unloading station (8) after a time sufficient to consolidate sealing.

13 Claims, 6 Drawing Sheets

METHOD FOR SEALING CAPSULES AND APPARATUS TO PERFORM SAID METHOD

TECHNICAL FIELD

The present invention relates to a procedure and an apparatus for sealing capsules formed of a body and a cap inserted axially and partially one inside the other, for example cylindrical capsules of solid gelatin containing pharmaceuticals to be administered orally together with the capsule.

DESCRIPTION OF THE RELATED ART

A method and a relative device to perform it are known, wherein the capsules are deposited in respective seats produced and distributed regularly in slats of a conveyor belt. This conveyor is designed to carry the capsules to an element that distributes a sealing solution along the rim of the cap of the capsule, and then to maintain the capsules in a ventilated environment for the time required for the seal to dry and consolidate. A method of this type is for exampled utilized by apparatus called "Hicapseal 40" and "Hicapseal 100" marketed by Schaefer Technologies Inc., 4251 N.Shadeland Av. Indianapolis (Ind.) 46226 USA. An important drawback of these apparatus is the large number of slats with seats for the capsules required to guarantee drying and consolidation of the seal prior to unloading the sealed capsules. With this arrangement, each time the form and/or dimension of the capsules to be sealed changes, all the slats must be replaced, with a laborious operation that immobilizes the apparatus for a considerable time.

SUMMARY OF THE INVENTION

The object of the present invention is to essentially reduce said drawback.

The invention comprises a method to place the capsules to be sealed in respective seats of a first rigid support movable in steps, the support being designed to feed the capsules to means that distribute a suitably heated sealing solution along the rim of the cap of each capsule, to transport the capsules thereby wetted for a certain number of steps to a transfer station in a second rigid support movable in steps provided with a plurality of seats each designed to contain a respective capsule, the number of seats of said second support being much larger, possibly multiple, than those of the seats of the first support. The second movable support then in turn transports the capsules for a certain number of steps to an unloading station of the sealed capsules. The dwell time of each support between one step and the next and the number of steps required to transfer a wetted capsule to the unloading station are such that the overall time between distribution of the sealing solution on the capsule and its unloading are sufficient to consolidate sealing.

The seats of the supports are shaped to contain the capsules with minimum clearance.

The change in format of the capsules to be sealed therefore causes replacement of the two rigid supports, a simple and rapid operation, with an advantage with respect to the aforesaid prior art.

In a preferred embodiment of the invention, according to the method the capsules are disposed in the first rigid support according to a horizontal position and in the second rigid support in a vertical position. In this way, as the overall length of the capsules is generally much greater than the width, a much larger number of capsules can be disposed on the second support, although the dimension of said support can remain limited, for example with overall dimensions essentially similar to those of the first support.

Preferably, the capsules in the second support are disposed with the cap facing downwards, to allow unloading of the capsules from the sealing apparatus through gravity.

The invention also relates to an apparatus to perform the method hereinbefore, which apparatus is provided with means to feed capsules positioned for sealing, means to distribute a sealing solution on the capsules and a computerized control unit to coordinate the members of the apparatus to perform said method. According to the invention, the apparatus also includes:

- two rigid supports movable in steps, each provided with seats designed to contain with minimum clearance the capsules to be sealed, the seats of the second support being in a much larger number than the seats of the first support;
- for each movable support, respective means for stepped feed;
- means to transfer the capsules from the first to the second movable support; and
- means to unload the sealed capsules from the second movable support.

In a preferred embodiment of the invention, said movable supports are in the form of circular platforms with vertical axis revolving around their own axis and of a depth similar to the depth of the capsules to be sealed. Said seats to contain the capsules of each platform are through apertures produced in the platform and distributed regularly according to coaxial circumferences, each platform resting on a respective fixed table to prevent the capsules from being dropped.

Preferably, the apertures in the first platform are distributed in the same number according to one or more concentric circumferences spaced apart and the apertures of the second platform are distributed in the same number according to a larger number of radially equidistant concentric circumferences.

The sealing means employed in the aforesaid known apparatus include at least an element to distribute a sealing solution in the form of a thin disk with a horizontal axis, the rim of which is partially immersed in a container containing the suitably heated liquid sealing solution. The disk comes into contact subsequently, one at a time, with the capsules raising them slightly from their support and giving them a rotating movement. In this way, the disk transfers a little of the liquid solution from its periphery to the periphery of the rim of the cap of the capsule. The periphery of the disk, in a radial section, is configured with a ridge, so as to come into contact both with the cap and with the body of the capsule. The solution can thus wet both parts of the capsule and, penetrating between them through capillarity, seal them together. Nonetheless, each capsule is slowed in rotation by friction against the edge of the seat in which it is located and it is therefore possible for its rotation to be irregular so that not all of the rim of the cap is wetted with the sealing liquid.

According to the present invention, to distribute the sealing liquid on the rim of the capsules, a similar device is used wherein, however, to overcome this drawback, an oscillating element is provided at the level of the distributor disk of the sealing solution, comprising a motorized pressure roller that rotates together with the disk in the same direction as it and at the same peripheral speed, and which rests on the capsule to be sealed on the opposed side of the distributor disk. In this way the capsule—guided inside its seat—remains held between the distributor disk and the pressure roller, both rotating concordantly, ensuring uniform rotation of the capsule. Preferably, the pressure roller has on its periphery, for each capsule, a pair of gaskets made of rubber or another resilient material, designed—in the manner of two disks placed side by side at a limited distance from each other—to come into contact with the capsule on opposed sides with respect to the rim of the cap of the capsule. These gaskets are both spaced from said rim, so that they do not come into contact with the solution distributed thereon.

To transfer the capsules from the first to the second platform, the platforms—with the respective fixed tables—are partly superimposed horizontally and moved vertically close to each other, one above the other, to allow gravity transfer. In fact, on the fixed table positioned under the upper platform, for each circumference of apertures, a through aperture is provided designed to allow a capsule to be dropped from a seat in the upper platform to a seat in the lower platform, and provided under the lower disk are suction means designed to accelerate and guide this dropping. Moreover, the assembly of the second platform with the relative fixed surface can be moved radially in steps with respect to the first platform, to present in succession a different circular row of apertures to receive the capsules.

Preferably, the capsules to be sealed are disposed in the first platform in a horizontal position, with the axis of the capsule disposed radially and, for capsules with an elongated form, in the second platform in a vertical position, with means provided to vary the position of the capsules during their transfer from the first to the second platform. In this way, as the transverse section of the capsules is generally much smaller than the axial section, a much larger number of capsules can be distributed on the second platform than those that can be contained in the first platform.

Said means to vary the position comprise, in each through aperture of the fixed table adjacent to the first platform, two projections to support the capsule to be transferred, said projections being disposed inside the aperture at the level of the opposed ends of the capsule. One of these projections, is movable by means of a controlled actuator to free the through aperture and allow one end of the capsule to drop, so that it turns from a horizontal position to a vertical position while being drawn by said suction means inside a seat of the second disk.

The microprocessor control unit of the apparatus is designed to control, in a synchronized manner and in pre-established times, stepped rotation of the two platforms and relative translation of the second platform with respect to the first, activation of the means to transfer the capsules from the first to the second platform and in general synchronized operation of the means to feed the capsules and distribute the sealing solution.

The invention shall now be better understood by the following description and accompanying drawing, which shows a non-limiting example of the invention, in particular an apparatus according to the invention for sealing capsules of elongated form containing a pharmaceutical.

DETAILED DESCRIPTION

Figure 10:
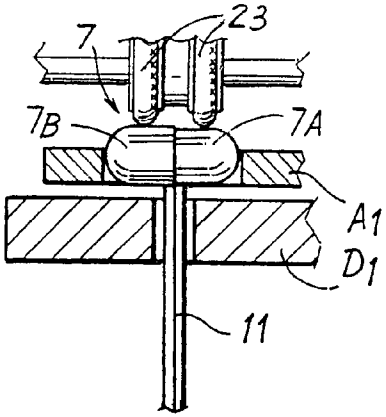
FIG. 10 is the detail X in FIG. 8 enlarged.
Figure 9:
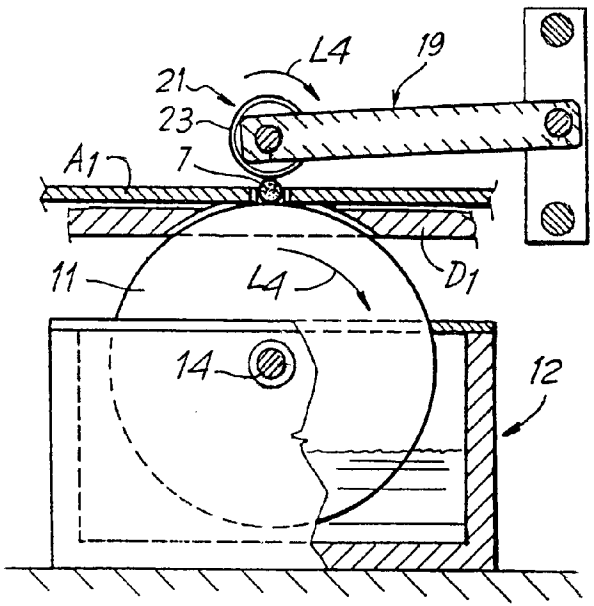
FIG. 9 is a sectional view according to IX—IX in FIG. 8.
Figure 8:
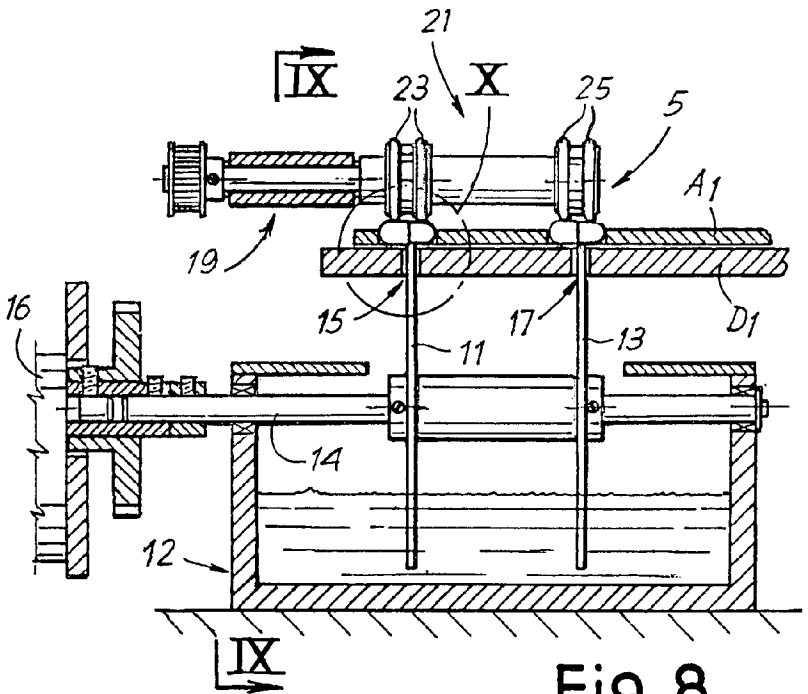

The capsules 7 (FIG. 10) to be sealed have an elongated form with a circular cross section and are formed of a hollow body 7A and cap 7B, the cap being inserted over the body.

Figure 1:
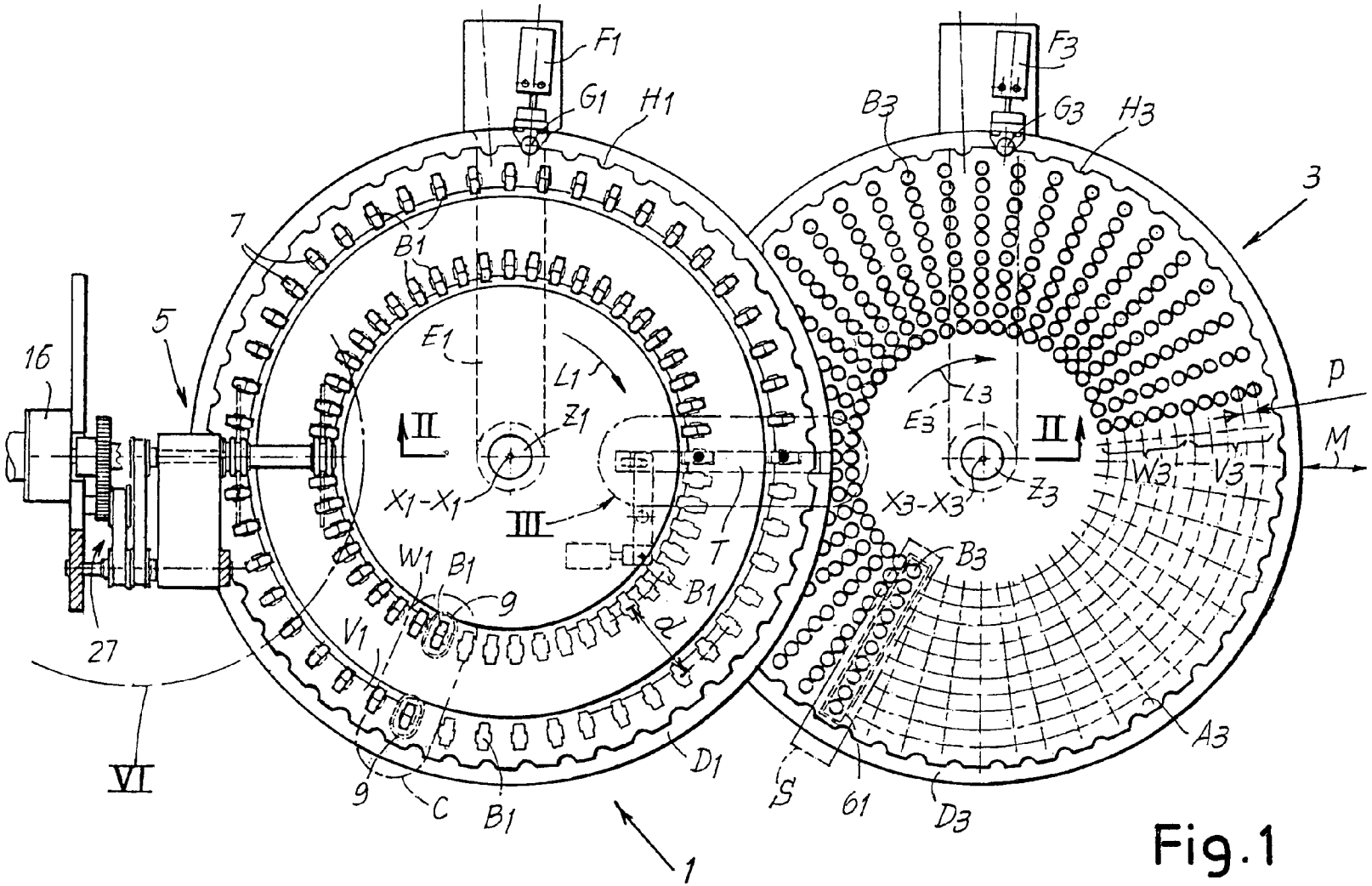
FIG. 1 is a plan vide of an apparatus for sealing capsules according to the invention.
Figure 2:
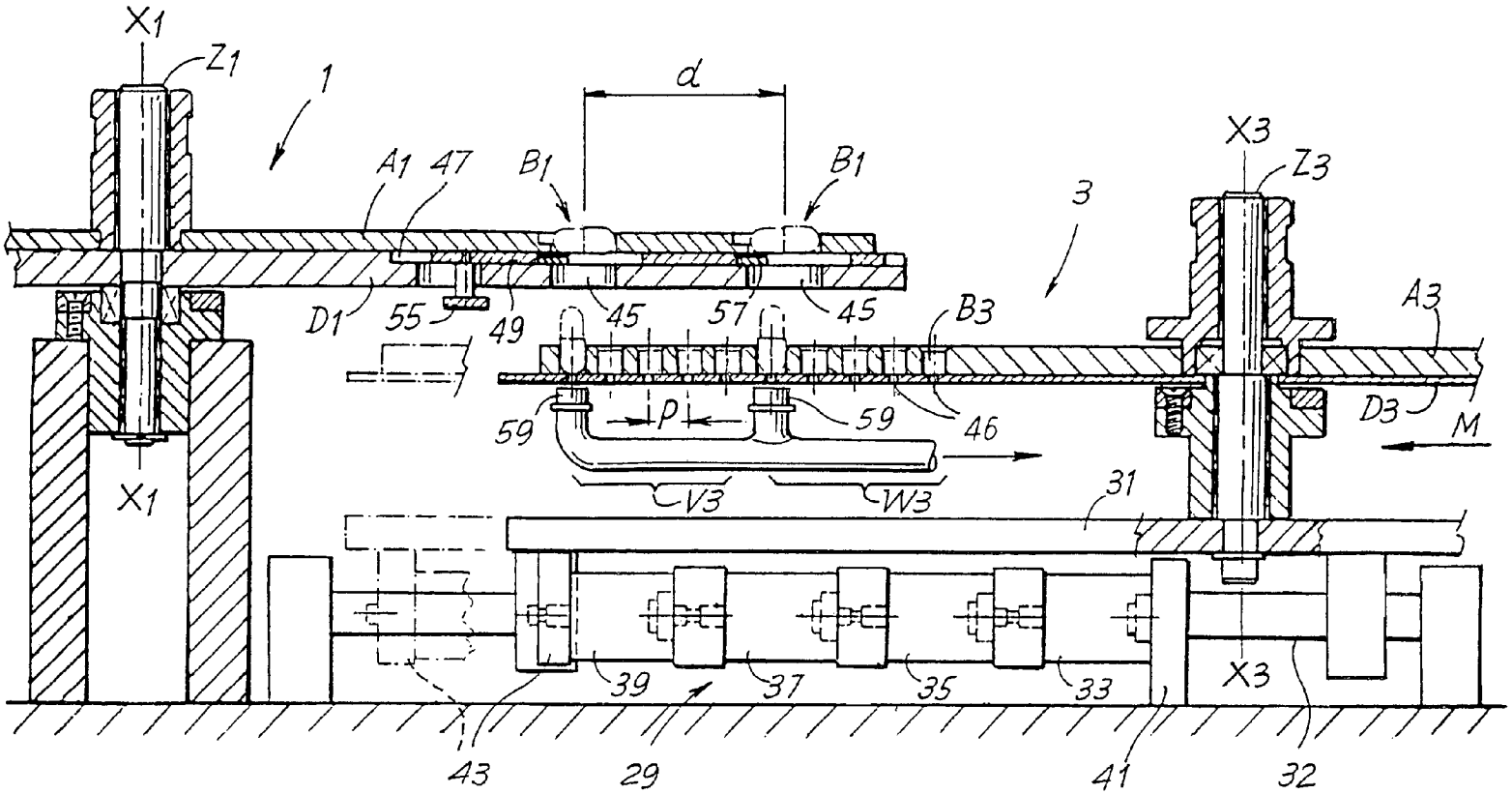
FIG. 2 is a partially enlarged sectional side view according to II—II in FIG. 1.

With reference to FIGS. 1 and 2, the apparatus comprises a pair of disk-shaped assemblies 1, 3 with vertical axis, each of which comprising an upper circular platform A1, A3 revolving around a respective vertical shaft Z1, Z3; in said platform respective pluralities of through apertures B1, B3 are produced, each designed to receive a capsule 7 to be sealed. Each platform is positioned above, at a slight distance (i.e. 1 mm), a respective fixed table D1, D3, and is provided with a feed device comprising an arm E1, E3 revolving around the respective shaft Z1, Z3 and fitted at the end with a pneumatic jack F1 F3 designed to engage/disengage a pin G1, G3 in successive notches H1, H3 produced on the periphery of the platform, to draw it in rotation. The notches H1, H3 are distributed uniformly on the periphery of each platform A1, A3. For each platform A1, A3 a respective feed device, not shown in the drawing, periodically makes each arm E1, E3 rotate by an angle equal to the angular pitch of the notches with a pre-established dwell time between one rotation and the next, and operation of the jack F1, F3 is coordinated with this oscillating movement so as to cause intermittent rotation of each platform A1, A3 in the direction of the arrows L1, L3. Between one angular feed movement and the next, each platform A1, A3 is held in the position reached by means of a respective elastic or controlled stop device, not shown in the drawing, which engages in the notches H1, H3.

The apertures B1 are distributed uniformly on the platform A1 in an equal number, with the same angular pitch as the notches H1, according to two concentric circumferences V1, W1 spaced from each other by a distance (d), the apertures of the two circumferences being aligned with one another in twos in a radial direction.

Figure 3:
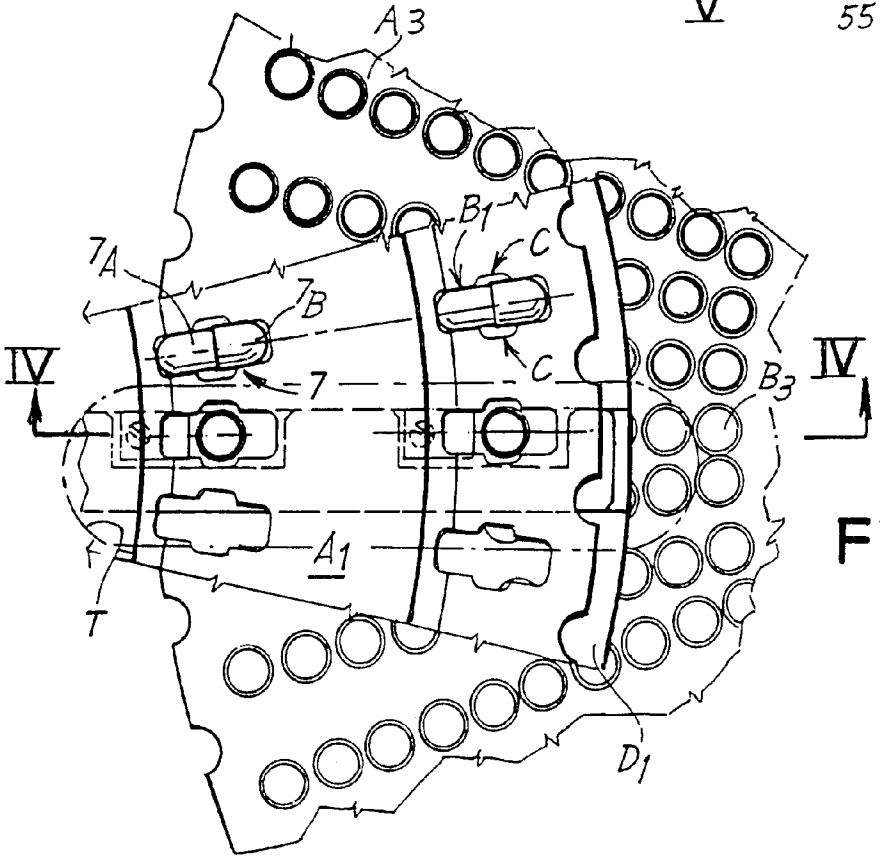
FIG. 3 is the detail III in FIG. 1 enlarged.

By means of a loading hopper and a positioning device, known per se, and moreover by means of a pair of ducts 9 terminating above the platform A1 at the level of a feed station C, the capsules are disposed in the apertures B1 of the disk A1 in a horizontal position, resting on the upper surface of the fixed table D1, with the axis positioned radially to the platform. The form of the apertures B1 is mainly rectangular, to contain with minimum clearance the capsule disposed horizontally, and has at the center two opposed recesses C (FIG. 3) at the level of the rim of the cap 7B of the capsule, so that the edge of the aperture does not come into contact with the liquid solution distributed along the rim of the cap of the capsule.

Through transfer means, which shall be described hereunder, the capsules are then transferred from the platform A1 into the apertures B3 of the platform A3. The apertures B3 are circular in shape and designed to hold the capsule in the vertical position with minimum clearance, with the cap 7B positioned facing downwards. This arrangement makes it possible to produce in the platform A3 a number of apertures five times the number produced in the platform A1, said platforms having more or less equal overall dimensions. The apertures B3 are distributed uniformly on the platform A3, with the same angular pitch as the notches H3, according to a number of concentric circumferences (ten in the present example) radially distanced from one another by a constant pitch (p) equal to a fifth of the radial distance (d) of the apertures B1 of the platform A1 (see also FIG. 2). The apertures B3 of the various circumferences are aligned with one another in a radial direction and, for the reason to be clarified hereunder, are considered as divided radially into two groups of five, an outer group V3 and an inner group W3.

Positioned beside the first platform A1, downstream of the station 9 in the direction L1 of rotation, fitted to the base of the apparatus is a device to distribute the liquid solution 5 (see also FIGS. 5 to 10), comprised, for each row of apertures V1, W1 of the first platform A1, of a thin disk 11, 13, both partially immersed in a container 12 with the liquid solution. The rim of the disks 11, 13 is of the same thickness as the portion of the capsule to be wetted and, through respective through apertures 15, 17 produced in the fixed table D1 at the level of each row V1, W1 of apertures B1, with stepped rotation of the platform A1 comes into contact successively-raising them slightly-with the capsules 7 disposed inside the apertures B 1. The edge of the disks has a ridge similar to the one between the cap 7B and the body 7A of the capsule, so that it comes into contact with both parts of the capsule. Each disk 11, 13 is keyed onto a common shaft 14 made to rotate by an electric motor 16, so that the capsule 7 with which it comes into contact is made to rotate, wetting it with the solution collected from the container 12 along the entire circular periphery of the capsule.

The distributor device 5 also comprises an oscillating element 19 that carries, projecting radially above the platform A1, a pressure roller 21 rotating together with the disks 11, 13 in the same direction L4. The roller 21 has on the periphery, at the level of each row V1, W1 of aperture B1, a pair of rubber gaskets 23, 25 designed to come into contact with the capsules contained in the apertures B1 on opposed sides and spaced with respect to the rim of the cap 7B of the capsules. The roller 21 is made to rotate by the same motor 16 by means of a gear transmission 27 and toothed belts, so that the peripheral speed of the gaskets 23, 25 is equal to the speed of the disks 11, 13. In this way by means of said gaskets the roller 21 rests on the capsules 7, which are slightly raised by the disks 11, 13 and contributes towards keeping them in rotation to distribute the solution uniformly on the rim of the cap 7B of said capsules.

The platform A3 is placed partially under the platform A1 (see also FIGS. 2 to 4) and, by means of a translation device 29, can be translated radially according to the arrow M with respect to the platform A3. The shaft Z3, which supports the platform A3 and the fixed table D3, is fitted to a plate 31 sliding in the direction M with respect to the base of the apparatus by means of a pair of guides 32, only one of which is shown in FIG. 2. Therefore, the platform A3 can be translated radially towards the platform A1 from the position in FIG. 2 wherein, in a transfer station T, the first aperture B3 on the left (looking at FIG. 2) of each group V3, W3 is aligned vertically under a corresponding aperture 45 of a pair of apertures produced in the fixed table D1, to a second position wherein the second aperture of said groups V3, W3 of apertures is vertically aligned under said apertures 45. Between one translation and the next the platform A1 is rotated by one step, so that another pair of apertures B1 containing capsules are positioned above the apertures 45. The movement to translate the platform A3 and rotate the platform A1 is repeated, until the capsules are transferred to all the apertures B3 of a radial row of said apertures. The direction of translation is then inverted and the method continues with transfer of the capsules in an adjacent row of apertures 3, as so forth.

For this purpose, the translation device 29 comprises four pneumatic jacks 33 to 39 (FIG. 2) aligned in series in the direction M and interposed between an upright 41 fixed to the base of the apparatus and an upright 43 fixed to the plate 31. Each jack allows travel equal to the pitch (p) of the circumferences V3, W3, the rod of the first jack 33 being fixed to the body of the second jack 35 and so forth. In this way, by operating the jacks 33 to 39 one at a time, it is possible to radially translate the lower platform A3 with respect to the upper platform A1, moving it closer or farther away by the desired number of pitches (p) in the horizontal direction M.

Figure 4:
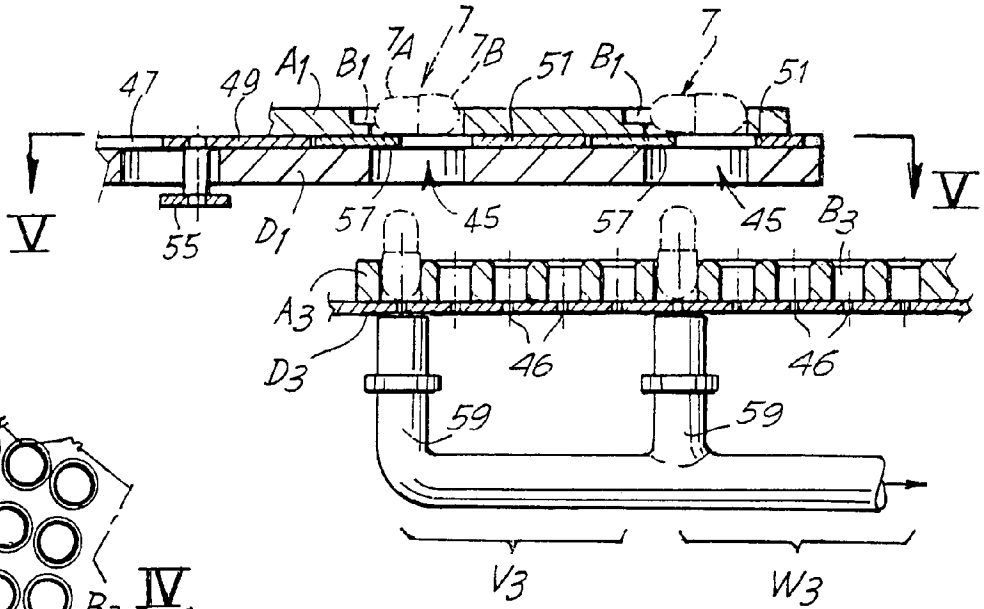
FIGS. 4 and 4A each is a sectional view according to IV—IV in FIG. 3, in two different positions of the members represented.
Figure 4A:
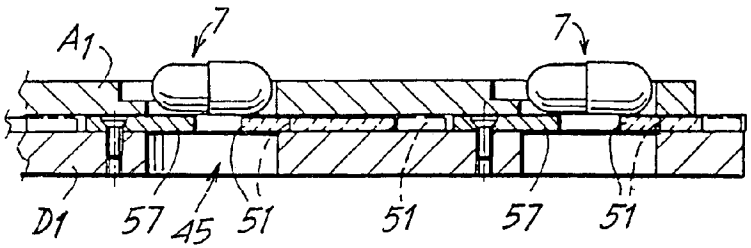
Figure 5:
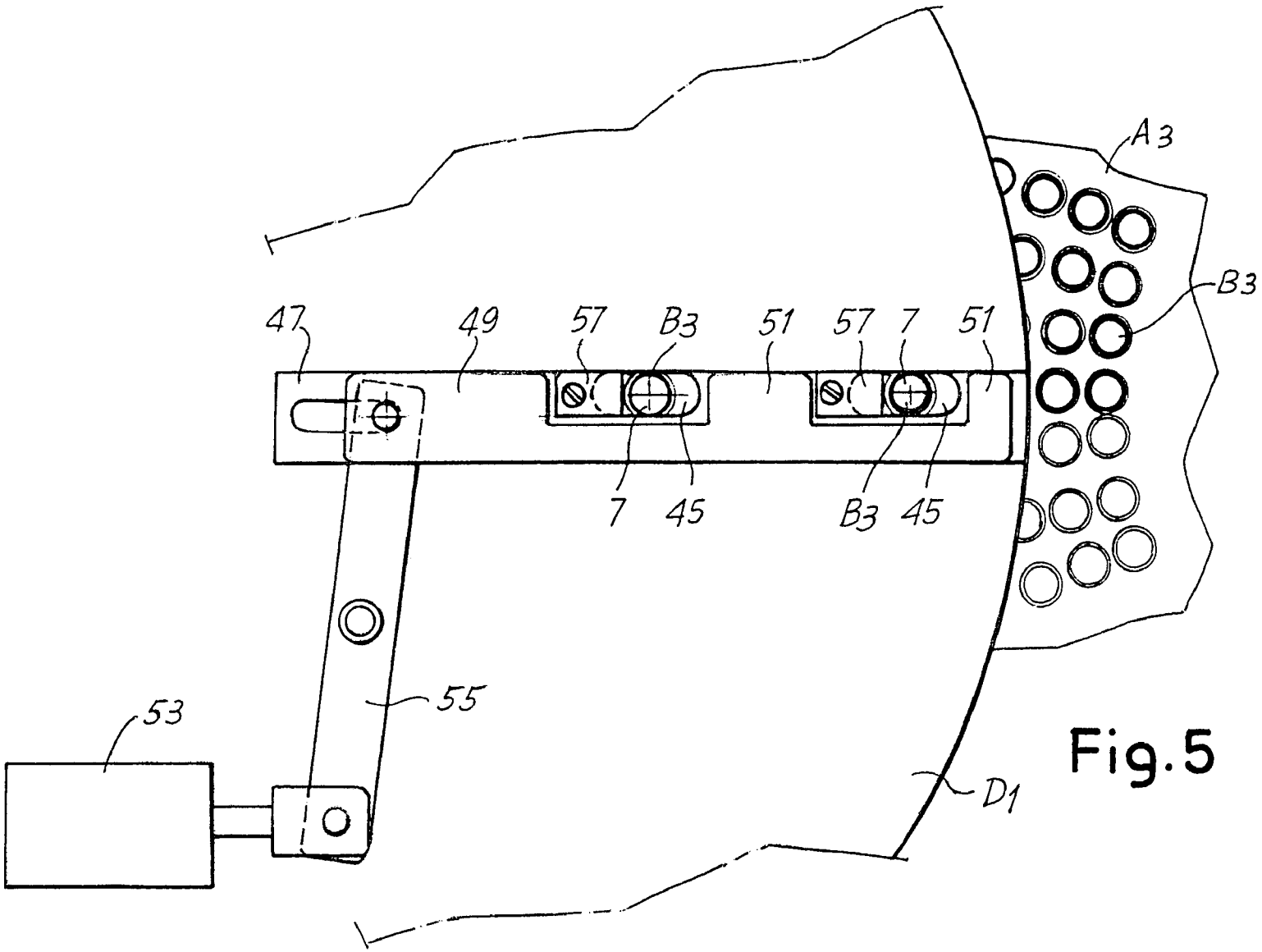
FIG. 5 is a partial plan and sectional view according to V—V in FIG. 4.
Figure 6:
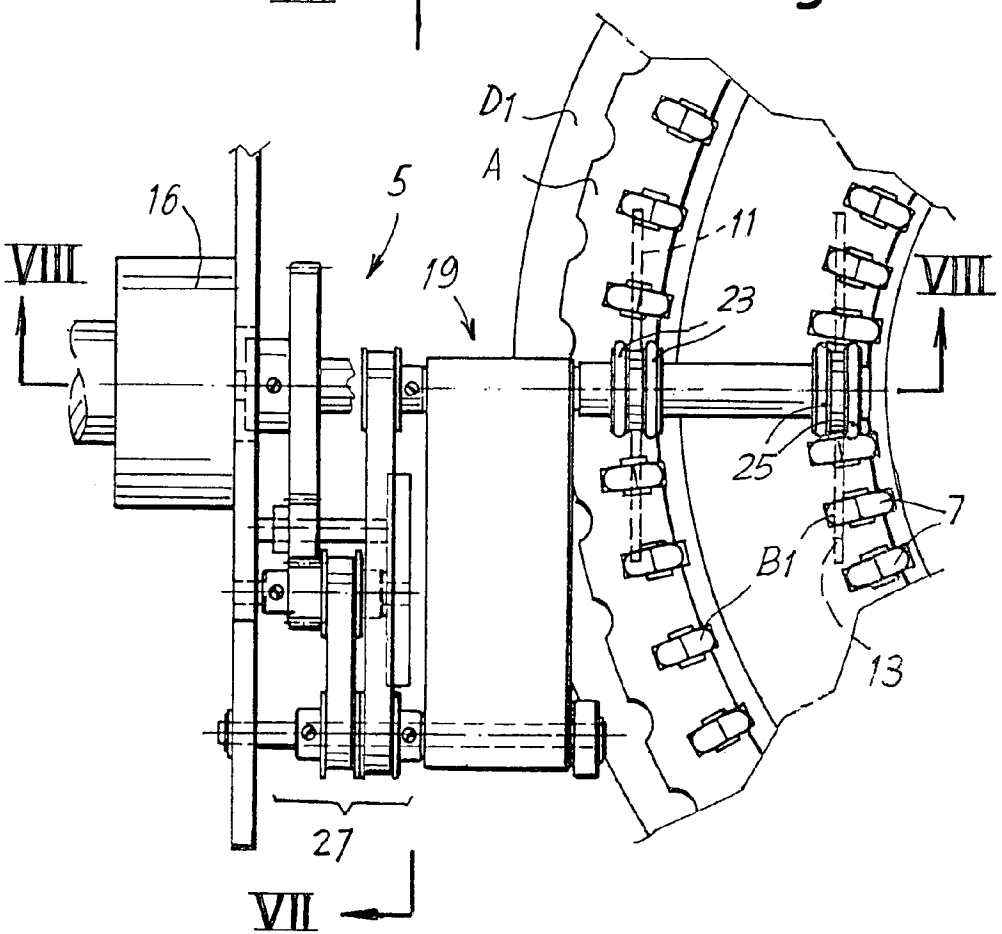
FIG. 6 is a the detail VI in FIG. 1 enlarged.
Figure 7:
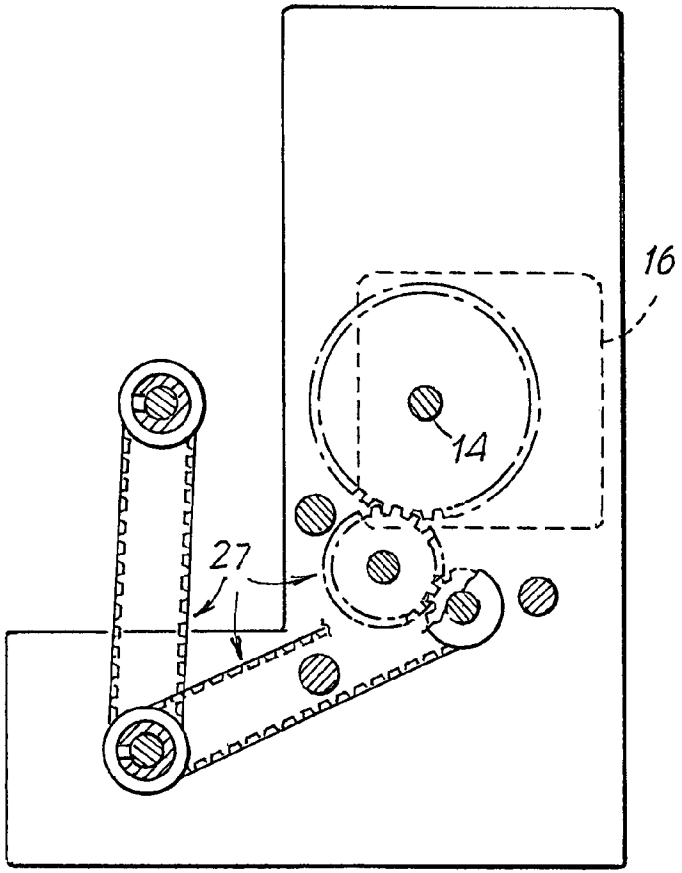
FIGS. 7 and 8 respectively are sectional views according to VII—VII and VIII—VIII in FIG. 6.

Above the table D1, at the level of the through apertures 45, a groove 47 is produced wherein a plate 49 runs (see also FIGS. 5 and 11). The edge of this plate has a pair of teeth 51, which normally project (FIG. 4A) respectively in each through aperture 45 under the end of the cap 7B of the capsules contained in the apertures B1, to support them. Two fixed plates 57 are also fitted in the groove 47, each to project in a respective through aperture 45 under the end of the base 7A of said capsules. By means of a pneumatic actuator 53 and an operating lever 55, the teeth 51 can be withdrawn from the through apertures 45, as shown in FIG. 4. In this way the capsules 7 which with rotation of the platform A1 are positioned above the through holes 45, are temporarily supported at the ends by the teeth 51 and the plates 57. By operating the actuator 53, the teeth 51 are withdrawn from the through holes 45 (see FIG. 4) and the caps 7B of the capsules B1 can be released, so that both the capsules, tilted from the horizontal position to a position with the cap facing downwards, are dropped from the through apertures into the underlying seats B3 of the platform A3. To facilitate and accelerate dropping, the fixed table D3 has through holes 46 at the level—horizontally—of the radial row of apertures B3 underneath the through apertures 45, and moreover respective suction nozzles 59 connected to a suction source are positioned under the fixed table D3, aligned vertically with the through apertures 45 of the table D1.

The apparatus is provided with a microprocessor control unit designed to control in a synchronized way stepped rotation and relative translation of the platforms A1, A3, activation of the actuator 53 to overturn the capsules, and general synchronized operation of the feeding and unloading means.

Therefore, in the operation of the apparatus described, from the feeding hopper (not shown in the drawing) by means of the nozzles 9 (FIG. 1), the capsules are fed in twos into respective apertures B1 of the circular alignments V1 and W1 of the platform A1. With stepped feed of the platform A1, the capsules are wetted with sealing solution at the level of the rim of the respective cap 7B by means of the distributor device 5 and remain on the platform A1 until reaching the transfer station T. From this station the capsules, through the apertures 45 of the fixed table D1, are dropped in pairs overturning from a horizontal position to a vertical position inside the apertures B3 of the platform A3 which, with stepped translation of the platform A3 and as described hereinbefore, were previously positioned under the apertures 45. Finally, after a certain number of angular steps of the platform A3, the capsules deposited thereon are dropped by gravity through an aperture 61 of the fixed table D3, onto an unloading station S of the capsules coming from the apparatus. The stepped rotation speed of the platforms A1, A3 is such that the total time the capsules 7 remain on the apparatus, after being wetted with the sealing solution until unloading from the station S, is sufficient to dry the seal.

It is understood that the drawing only shows an example provided purely as a practical embodiment of the invention, as the invention may vary in forms and arrangements without however departing from the scope of the concept forming said invention. Any reference numbers in the appended claims are provided to facilitate reading the claims with reference to the description, and do not limit the scope of protection represented by the claims.

What I claim is:

1. An apparatus for sealing cylindrical capsules formed of a body and of a cap inserted axially inside one another, comprising means to feed capsules positioned to be sealed, means to distribute a liquid sealing solution along the rim of the cap of each capsule and a computerized microprocessor control unit designed to coordinate the movement of the members of the apparatus, further including:

a first and a second horizontally circular platform-shaped supports angularly movable in steps, each provided with seats designed to contain the capsules to be sealed, the seats of said second circular platform-shaped support being in a much larger number than the seats of said first circular platform-shaped support and said second circular platform-shaped support partially underlying said first circular platform-shaped support;

for each circular platform-shaped support, respective means for stepped angular feed;

means to transfer the capsules from said first circular platform-shaped support to said second rigid circular platform-shaped support; and means to unload the sealed capsules from said second circular platform-shaped movable support;

a plurality of through apertures provided in each circular platform-shaped support, distributed regularly according to coaxial circumferences to form said seats for said capsules, each revolving circular platform-shaped support being superimposed and moved close to a respective fixed table designed to prevent the capsules from being dropped from said apertures, wherein said means to distribute the sealing solution include, for each row of apertures of said first circular platform-shaped support, a distributor disk partially immersed in a container containing the liquid sealing solution, said disk, through an aperture produced in said table underlying said first circular platform-shaped support at the level of each circular row of apertures coming, with stepped rotation of said first circular platform-shaped support, into contact successively with the capsules disposed inside the apertures of said first circular platform-shaped support, raising them slightly and said means to distribute the sealing solution include a pressure roller rotating together with said disk, in the same direction and at the same peripheral speed as said disk, said roller being carried by an oscillating element designed to place it on the capsule to be sealed on the opposite side of the respective distributor disk, to provide the capsules together with said disk with a rotating movement to allow said disk to uniformly transfer the liquid solution to the entire periphery of the rim of the cap of the capsule.

2. Apparatus as claimed in claim 1, wherein said apertures of said first circular platform-shaped support are distributed in the same number according to two concentric circumferences spaced apart and said apertures of said second circular platform-shaped support are distributed in the same number according to several concentric circumferences.

3. Apparatus as claimed in claim 1, wherein, for each capsule, said pressure roller has, projecting from the periphery, a pair of gaskets made of rubber or another resilient material designed to come into contact with the capsule on opposed parts with respect to the rim of the cap of the capsule, said gaskets each being spaced from said rim so that said pair of gaskets are not wet by the solution distributed thereon.

4. Apparatus as claimed in claim 1, wherein:

said revolving circular platform-shaped supports, with respective fixed tables, are partly superimposed horizontally and are moved vertically close one above the other;

in said fixed table of the upper platform for each circumference of apertures, an aperture is provided designed to allow a capsule to drop from an aperture of the upper platform into an aperture of the lower platform;

under the lower platform, horizontally at the level of apertures in said fixed table of the upper platform and in said fixed table of the lower platform, suction means are provided, designed to accelerate feed of the capsule from the upper platform to the lower platform; and translating means of the second platform are provided, designed to move it radially in steps with respect to the first platform, to position in succession apertures of the lower platform under apertures of the upper platform, to receive the capsules through gravity.

5. Apparatus as claimed in claim 1, for sealing capsules of elongated form, wherein the capsules are placed in the apertures of the first circular platform-shaped support in a horizontal position, with the axis of the capsule disposed radially to said first circular platform-shaped support, and the capsules in the second circular platform-shaped support are disposed in vertical position, means being provided to overturn the capsules during transfer from said first circular platform-shaped support to said second circular platform-shaped support.

6. Apparatus as claimed in claim 5, wherein said overturning means include, in the apertures of the surface underneath and adjacent to said first circular platform-shaped support, a respective pair of projections to support the capsule to be transferred, said projections being disposed inside the aperture at the level of the opposed ends of the capsule, one of said projections of each pair, by means of an actuator, being withdrawable from the aperture to allow the relative end of the capsule to drop overturning from a horizontal position to a vertical position.

7. Apparatus as claimed in claim 1, wherein said microprocessor control unit of the apparatus is designed to control in a synchronized way stepped rotation and relative translation of the platforms, an actuator to overturn the capsules, and general synchronized operation of the feeding and sealing means.

8. An apparatus for sealing and drying cylindrical capsules formed of a body and a cap inserted axially inside one another, said apparatus comprising:

a first horizontally circular platform-shaped support with a top and a bottom, said top including a plurality of horizontal seats, each horizontal seat including a through aperture means to selectively support a capsule in a horizontal position or drop the capsule through said through aperture means, said first circular platform-shaped support rotating in steps around a first axis and a transfer means to selectively transfer the capsules from said first rigid platform-shaped circular support through said through aperture to below;

a stepped angular feed means above said top to selectively feed the capsules onto each of said horizontal seat;

a sealing means below said bottom to distribute a liquid sealing solution along the rim of the cap of each capsule;

a second horizontally circular platform-shaped support placed partially underneath said first horizontally circular platform-shaped support and including another top and another bottom, said another top including a plurality of vertical seats to support the capsules in a vertical position and synchronously rotating in said steps around a second axis, wherein said plurality of vertical seats outnumber said plurality of horizontal seats;

an unloading means for unloading the sealed capsules from said second platform-shaped circular movable support; and a computerized microprocessor control unit designed to synchronize said steps, wherein said first and said second revolving circular platform-shaped supports are superimposed and move close to a respective first and a second fixed tables designed to prevent the capsules from being dropped from said through apertures, wherein said first fixed table includes a cross section through hole to allow selective capsules to drop through said through apertures and said sealing means include, for each row of apertures of said first platform-shaped circular support, a distributor disk partially immersed in a container containing a liquid sealing solution said distributor disk, through an aperture produced in first fixed table at the level of each circular row of apertures coming with stepped rotation of said first circular platform-shaped support, into contact successively with the capsules disposed inside the apertures of the first circular platform-shaped support, raising them slightly and said sealing means include a pressure roller rotating together with said distribution disk, in the same direction and at the same peripheral speed as said distribution disk, said roller being carried by an oscillating element designed to place the edge of said roller on the capsule to be sealed on the opposite side of said respective distributor disk, to provide the capsules together with said distributor disk with a rotating movement to allow said distributor disk to uniformly transfer the liquid solution to the entire periphery of the rim of the can of the capsule.

9. The apparatus according to claim 8, wherein, for each capsule, said pressure roller has, projecting from the periphery, a pair of gaskets made of rubber or another resilient material designed to come into contact with the capsule on opposed parts with respect to the rim of the cap of the capsule, said gaskets each being spaced from said rim so that they are not wet by the solution distributed thereon.

10. The apparatus according to claim 8, wherein:

said revolving circular platform-shaped supports, with respective fixed tables, are partly superimposed horizontally and are moved vertically close to one another;

in said fixed table of said first circular platform-shaped support for each circumference of apertures, an aperture is provided designed to allow a capsule to drop from an aperture of said upper platform into an aperture of said second circular platform-shaped support;

under said second circular platform-shaped support, horizontally at the level of apertures in said fixed table of the first circular platform-shaped support and in said fixed table of said second platform-shaped support, suction means are provided, designed to accelerate feed of the capsule from said first circular platform-shaped support to said second circular platform-shaped support; and translating means of the second circular platform-shaped support are provided, designed to move said second circular platform-shaped support radially in steps with respect to said first circular platform-shaped support, to position in succession apertures of said second circular platform-shaped support under apertures of said first platform-shaped support, to receive the capsules through gravity.

11. The apparatus according to claim 8, for sealing capsules of elongated form, wherein the capsules are placed in the apertures of said first circular platform-shaped support in a horizontal position, with the axis of the capsule disposed radially to said circular platform-shaped support, and the capsules in said second circular platform-shaped support are disposed in vertical position, overturning means being provided to overturn the capsules during transfer from said first circular platform-shaped support to said second platform-shaped support.

12. The apparatus according to claim 11, wherein said overturning means include, in the apertures of the surface underneath and adjacent to said first circular platform-shaped support, a respective pair of projections to support the capsule to be transferred, said projections being disposed inside the aperture at the level of the opposed ends of the capsule, one of said projections of each pair, by means of an actuator, being withdrawable from the aperture to allow the relative end of the capsule to drop overturning from a horizontal position to a vertical position.

13. The apparatus according to claim 8, wherein said microprocessor control unit is designed to control said synchronized stepped rotation and relative translation of said first and said second circular platform-shaped supports, an actuator to overturn the capsules, and general synchronized operation of said feeding and sealing means.

* * * * *